US006708154B2

(12) United States Patent
Acero

(10) Patent No.: US 6,708,154 B2
(45) Date of Patent: Mar. 16, 2004

(54) METHOD AND APPARATUS FOR USING FORMANT MODELS IN RESONANCE CONTROL FOR SPEECH SYSTEMS

(75) Inventor: Alejandro Acero, Redmond, WA (US)

(73) Assignee: Microsoft Corporation, Redmond, WA (US)

( * ) Notice: Subject to any disclaimer, the term of this patent is extended or adjusted under 35 U.S.C. 154(b) by 0 days.

(21) Appl. No.: 10/294,129

(22) Filed: Nov. 14, 2002

(65) Prior Publication Data

US 2003/0097266 A1 May 22, 2003

Related U.S. Application Data

(62) Division of application No. 09/389,898, filed on Sep. 3, 1999, now Pat. No. 6,505,152.

(51) Int. Cl.[7] ..... G10L 13/00; G10L 13/04; G10L 19/06

(52) U.S. Cl. ..... 704/260; 704/264; 704/266; 704/209

(58) Field of Search ..... 704/209, 239, 704/256, 262, 268, 260, 218, 264

(56) References Cited

U.S. PATENT DOCUMENTS

| | | | | | |
|---|---|---|---|---|---|
| 3,624,302 | A | * | 11/1971 | Atal | 704/262 |
| 3,808,370 | A | * | 4/1974 | Jackson et al. | 704/218 |
| 3,828,132 | A | * | 8/1974 | Flanagan et al. | 704/268 |
| 4,130,730 | A | * | 12/1978 | Ostrowski | 704/264 |
| 4,343,969 | A | | 8/1982 | Kellett | 704/254 |
| 4,424,415 | A | * | 1/1984 | Lin | 704/209 |
| 4,813,075 | A | | 3/1989 | Ney | 381/43 |
| 4,831,551 | A | | 5/1989 | Schalk et al. | 364/513.5 |
| 5,042,069 | A | | 8/1991 | Chhatwall et al. | 704/229 |
| 5,146,539 | A | | 9/1992 | Doddington et al. | 704/254 |
| 5,381,512 | A | | 1/1995 | Holton et al. | 704/200.1 |
| 5,649,058 | A | | 7/1997 | Lee | 395/2.77 |
| 5,701,390 | A | | 12/1997 | Griffin et al. | 704/206 |
| 5,729,694 | A | | 3/1998 | Holzrichter et al. | 704/270 |
| 5,742,928 | A | * | 4/1998 | Suzuki | 704/239 |
| 5,754,974 | A | | 5/1998 | Griffin et al. | 704/206 |
| 5,768,603 | A | * | 6/1998 | Brown et al. | 704/256 |
| 5,911,128 | A | | 6/1999 | DeJaco | 704/200.1 |
| 6,006,180 | A | | 12/1999 | Bardaud et al. | 4/264 |
| 6,292,775 | B1 | * | 9/2001 | Holmes | 704/268 |

FOREIGN PATENT DOCUMENTS

| | | | |
|---|---|---|---|
| EP | 0878790 | 11/1998 | |
| JP | 64-064000 | 9/1989 | |
| JP | 11-327592 | * 11/1999 | G10L/3/02 |
| JP | 2000-099094 | * 4/2000 | G10L/19/02 |
| WO | WO 9316465 | 8/1993 | |

OTHER PUBLICATIONS

Vanhove ("An Algorithm For LPC Synthesis Gain Matching", IEEE Transactions on Acoustics, Speech, and Signal Processing, Dec. 1983).*

Bhimani et al ("An Approach To Speech Synthesis And Recognition On A Digital Computer", Proceedings of the ACM/CSC–ER 1966 21st National Conference Jan. 1966).*

El–Imam ("Speech Analysis And Synthesis On A Personal Computer", Proceedings of the 1986 ACM SIGSMALL/PC Symposium on Small Systems, Dec. 1986).*

(List continued on next page.)

*Primary Examiner*—Richemond Dorvil
*Assistant Examiner*—Daniel Nolan
(74) *Attorney, Agent, or Firm*—Theodore M. Magee; Westman, Champlin & Kelly, P.A.

(57) ABSTRACT

A model is provided for formants found in human speech. Under one aspect of the invention, the model is used to synthesize speech. Under this aspect of the invention, the formant model is used to identify a most likely formant track for the synthesized speech. Based on this track, a series of resonators are used to introduce the formants into the speech signal.

20 Claims, 9 Drawing Sheets

OTHER PUBLICATIONS

Al–Janabi et al ("Effective–Fourth–Order Resonator Based Mash Bandpass Sigma–Delta Modulators", IEEE International Conference on Acoustics, Speech, and Signal Processing, Apr. 1997).*

Haas et al ("A Multi–Band Nonlinear Oscillator Model For Speech", Conference Record of the Thirty–Second Asilomar Conference on Signals, Systems & Computers, Nov. 1998) nonlinear self–oscillating systmes model speech without external excitation consi.*

"A New Paradigm for Reliable Automatic Format Tracking", by Yves Laprie et al., ICASSP–94, vol. 2, pp. 201–204, (1992).

"System for Automatic Formant Analysis of Voiced Speech", by Ronald W. Schafer et al., *The Journal of the Acoustical Society of America,* vol. 47, No. 2 (Part 2), pp. 634–648, (1970).

"Acoustic Parameters of Voice Individuality and Voice–Quality Control by Analysis–Synthesis Method," by Kuwabara et al., Speech Communication 10 North–Holland, pp. 491–495 (Jun. 15, 1991).

"Tracking of Partials for Additive Sound Synthesis Using Hidden Markov Models," by Depalle et al., 1993 IEEE International Conference on Acoustics, Speech and Signal Processing, pp. 225–228 (Apr. 27, 1993).

"A Formant Vocoder Based on Mixtures of Gaussians," by Zolfaghari et al., IEEE International Conference on Acoustic Speech and Signal Processing, pp. 1575–1578 (1997).

"Application of Markov Random Fields to Formant Extraction," by Wilcox et al., International Conference on Acoustics, Speech and Signal Processing, pp. 349–352 (1990).

"Role of Formant Frequencies and Bandwidths in Speaker Perception," by Kuwabara et al., Electronics and Communications in Japan, Part 1, vol. 70, No. 9, pp. 11–21 (1987).

"A Family of Formant Trackers Based on Hidden Markov Models," by Gary E. Kopec, International Conference on Acoustics, Speech and Signal Processing, vol. 2, pp. 1225–1228 (1986).

"A Mixed–Excitation Frequency Domain Model for Time–Scale Pitch–Scale Modification of Speech", by Alex Acero, Proceedings of the International Conference on Spoken Language Processing, Sydney, Australia, pp. 1923–1926 (Dec. 1998).

"From Text to Speech: The MITalk System", by Jonathan Allen et al., MIT Press, Table of Contents pp. v–xi, Preface pp. 1–6 (1987).

"Comparison of Parametric Representation for Monosyllabic Word Recognition in Continuously Spoken Sentences", by Steve B. Davis et al., IEEE Transactions on Acoustics, Speech, and Signal Processing, vol. ASSP–28, No. 4, pp. 357–366 (Aug. 1980).

"Whistler: A Trainable Text–to–Speech System", by Xuedong Huang et al., Proceedings of the International Conference on Spoken Language Systems, Philadelphia, PA, pp. 2387–2390 (Oct. 1996).

"An Algorithm for Speech Parameter Generation from Continuous Mixture HMMS with Dynamic Features", by Keiichi Tokuda et al., Proceedings of the Eurospeech Conference, Madrid, pp. 757–760 (Sep. 1995).

"Extraction of Vocal–Tract System Characteristics from Speech Signals", by B. Yegnanarayana, IEEE Transactions on Speech and Audio Processing, vol. 6, No. 4, pp. 313–327 (Jul. 1998).

Vucetic, "A Hardware Implementation of Channel Allocation Algorithms Based on A Space–Bandwidth Model of A Cellular Network," IEEE (May 1992).

* cited by examiner

METHOD AND APPARATUS FOR USING FORMANT MODELS IN RESONANCE CONTROL FOR SPEECH SYSTEMS

RELATED APPLICATIONS

This application is a divisional of U.S. patent application Ser. No. 09/389,898 filed on Sep. 3, 1999 U.S. Pat. No. 6,505,152.

BACKGROUND OF THE INVENTION

The present invention relates to speech recognition and synthesis systems and in particular to speech systems that exploit formants in speech.

In human speech, a great deal of information is contained in the first three resonant frequencies or formants of the speech signal. In particular, when a speaker is pronouncing a vowel, the frequencies and bandwidths of the formants indicate which vowel is being spoken.

To detect formants, some systems of the prior art utilize the speech signal's frequency spectrum, where formants appear as peaks. In theory, simply selecting the first three peaks in the spectrum should provide the first three formants. However, due to noise in the speech signal, non-formant peaks can be confused for formant peaks and true formant peaks can be obscured. To account for this, prior art systems qualify each peak by examining the bandwidth of the peak. If the bandwidth is too large, the peak is eliminated as a candidate formant. The lowest three peaks that meet the bandwidth threshold are then selected as the first three formants.

Although such systems provided a fair representation of the formant track, they are prone to errors such as discarding true formants, selecting peaks that are not formants, and incorrectly estimating the bandwidth of the formants. These errors are not detected during the formant selection process because prior art systems select formants for one segment of the speech signal at a time without making reference to formants that had been selected for previous segments.

To overcome this problem, some systems use heuristic smoothing after all of the formants have been selected. Although such post-decision smoothing removes some discontinuities between the formants, it is less than optimal.

In speech synthesis, the quality of the formant track in the synthesized speech depends on the technique used to create the speech. Under a concatenative system, sub-word units are spliced together without regard for their respective formant values. Although this produces sub-word units that sound natural by themselves, the complete speech signal sounds unnatural because of discontinuities in the formant track at sub-word boundaries. Other systems use rules to control how a formant changes over time. Such rule-based synthesizers never exhibit the discontinuities found in concatenative synthesizers, but their simplified model of how the formant track should change over time produces an unnatural sound.

SUMMARY OF THE INVENTION

The present invention utilizes a formant-based model to improve the creation of formant tracks in synthesized speech. Text is divided into a sequence of formant model states, which are used to retrieve a sequence of stored excitation segments. The states are also provided to a formant path generator, which determines a set of most likely formant paths given the sequence of model states and the formant models for each state. The formant paths are then used to control a series of resonators, which introduce the formants into the sequence of excitation segments. This produces a sequence of speech segments that are later combined to form the synthesized speech signal.

DETAILED DESCRIPTION OF ILLUSTRATIVE EMBODIMENTS

Figure 1:
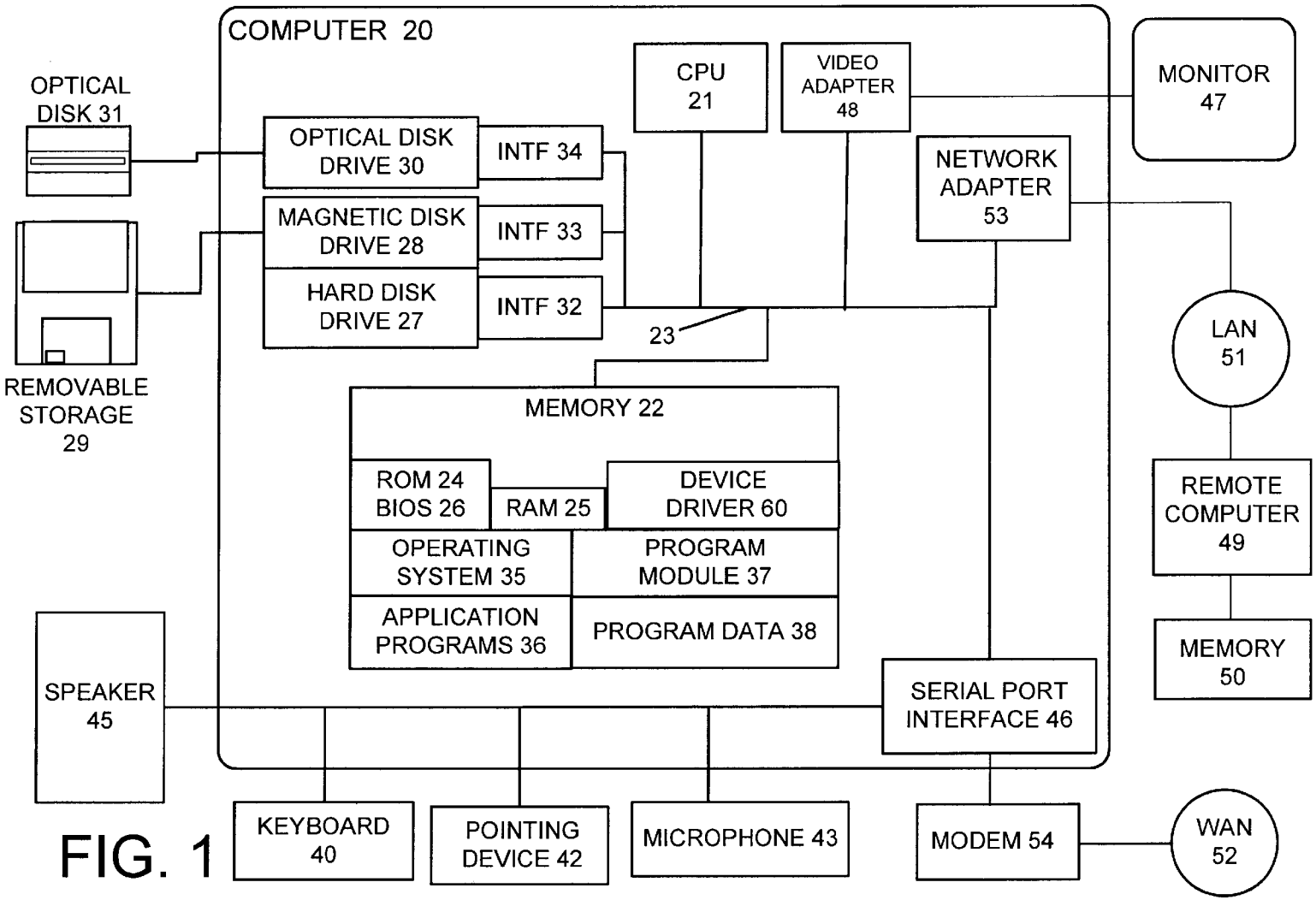
FIG. 1 is a block diagram of a general computing environment in which the present invention may be practiced.

FIG. 1 and the related discussion are intended to provide a brief, general description of a suitable computing environment in which the invention may be implemented. Although not required, the invention will be described, at least in part, in the general context of computer-executable instructions, such as program modules, being executed by a personal computer. Generally, program modules include routine programs, objects, components, data structures, etc. that perform particular tasks or implement particular abstract data types. Moreover, those skilled in the art will appreciate that the invention may be practiced with other computer system configurations, including hand-held devices, multiprocessor systems, microprocessor-based or programmable consumer electronics, network PCs, minicomputers, mainframe computers, and the like. The invention may also be practiced in distributed computing environments where tasks are performed by remote processing devices that are linked through a communications network. In a distributed computing environment, program modules may be located in both local and remote memory storage devices.

With reference to FIG. 1, an exemplary system for implementing the invention includes a general purpose computing device in the form of a conventional personal computer 20, including a processing unit (CPU) 21, a system memory 22, and a system bus 23 that couples various system components including the system memory 22 to the processing unit 21.

The system bus 23 may be any of several types of bus structures including a memory bus or memory controller, a peripheral bus, and a local bus using any of a variety of bus architectures. The system memory 22 includes read only memory (ROM) 24 and random access memory (RAM) 25. A basic input/output (BIOS) 26, containing the basic routine that helps to transfer information between elements within the personal computer 20, such as during start-up, is stored in ROM 24. The personal computer 20 further includes a hard disk drive 27 for reading from and writing to a hard disk (not shown), a magnetic disk drive 28 for reading from or writing to removable magnetic disk 29, and an optical disk drive 30 for reading from or writing to a removable optical disk 31 such as a CD ROM or other optical media. The hard disk drive 27, magnetic disk drive 28, and optical disk drive 30 are connected to the system bus 23 by a hard disk drive interface 32, magnetic disk drive interface 33, and an optical drive interface 34, respectively. The drives and the associated computer-readable media provide nonvolatile storage of computer readable instructions, data structures, program modules and other data for the personal computer 20.

Although the exemplary environment described herein employs the hard disk, the removable magnetic disk 29 and the removable optical disk 31, it should be appreciated by those skilled in the art that other types of computer readable media which can store data that is accessible by a computer, such as magnetic cassettes, flash memory cards, digital video disks, Bernoulli cartridges, random access memories (RAMs), read only memory (ROM), and the like, may also be used in the exemplary operating environment.

A number of program modules may be stored on the hard disk, magnetic disk 29, optical disk 31, ROM 24 or RAM 25, including an operating system 35, one or more application programs 36, other program modules 37, and program data 38. A user may enter commands and information into the personal computer 20 through local input devices such as a keyboard 40, pointing device 42 and a microphone 43. Other input devices (not shown) may include a joystick, game pad, satellite dish, scanner, or the like. These and other input devices are often connected to the processing unit 21 through a serial port interface 46 that is coupled to the system bus 23, but may be connected by other interfaces, such as a sound card, a parallel port, a game port or a universal serial bus (USB). A monitor 47 or other type of display device is also connected to the system bus 23 via an interface, such as a video adapter 48. In addition to the monitor 47, personal computers may typically include other peripheral output devices, such as a speaker 45 and printers (not shown).

The personal computer 20 may operate in a networked environment using logic connections to one or more remote computers, such as a remote computer 49. The remote computer 49 may be another personal computer, a hand-held device, a server, a router, a network PC, a peer device or other network node, and typically includes many or all of the elements described above relative to the personal computer 20, although only a memory storage device 50 has been illustrated in FIG. 1. The logic connections depicted in FIG. 1 include a local area network (LAN) 51 and a wide area network (WAN) 52. Such networking environments are commonplace in offices, enterprise-wide computer network Intranets, and the Internet.

When used in a LAN networking environment, the personal computer 20 is connected to the local area network 51 through a network interface or adapter 53. When used in a WAN networking environment, the personal computer 20 typically includes a modem 54 or other means for establishing communications over the wide area network 52, such as the Internet. The modem 54, which may be internal or external, is connected to the system bus 23 via the serial port interface 46. In a network environment, program modules depicted relative to the personal computer 20, or portions thereof, may be stored in the remote memory storage devices. It will be appreciated that the network connections shown are exemplary and other means of establishing a communications link between the computers may be used. For example, a wireless communication link may be established between one or more portions of the network.

Under the present invention, a Hidden Markov Model (HMM) is developed for formants found in human speech. The invention has several aspects including formant tracking, training a formant model, using the model to compress speech signals for later use in speech synthesis, and using the model to generate smooth formant tracks during speech synthesis. Each of these aspects is discussed separately below.

FORMANT TRACKING

Figure 2:
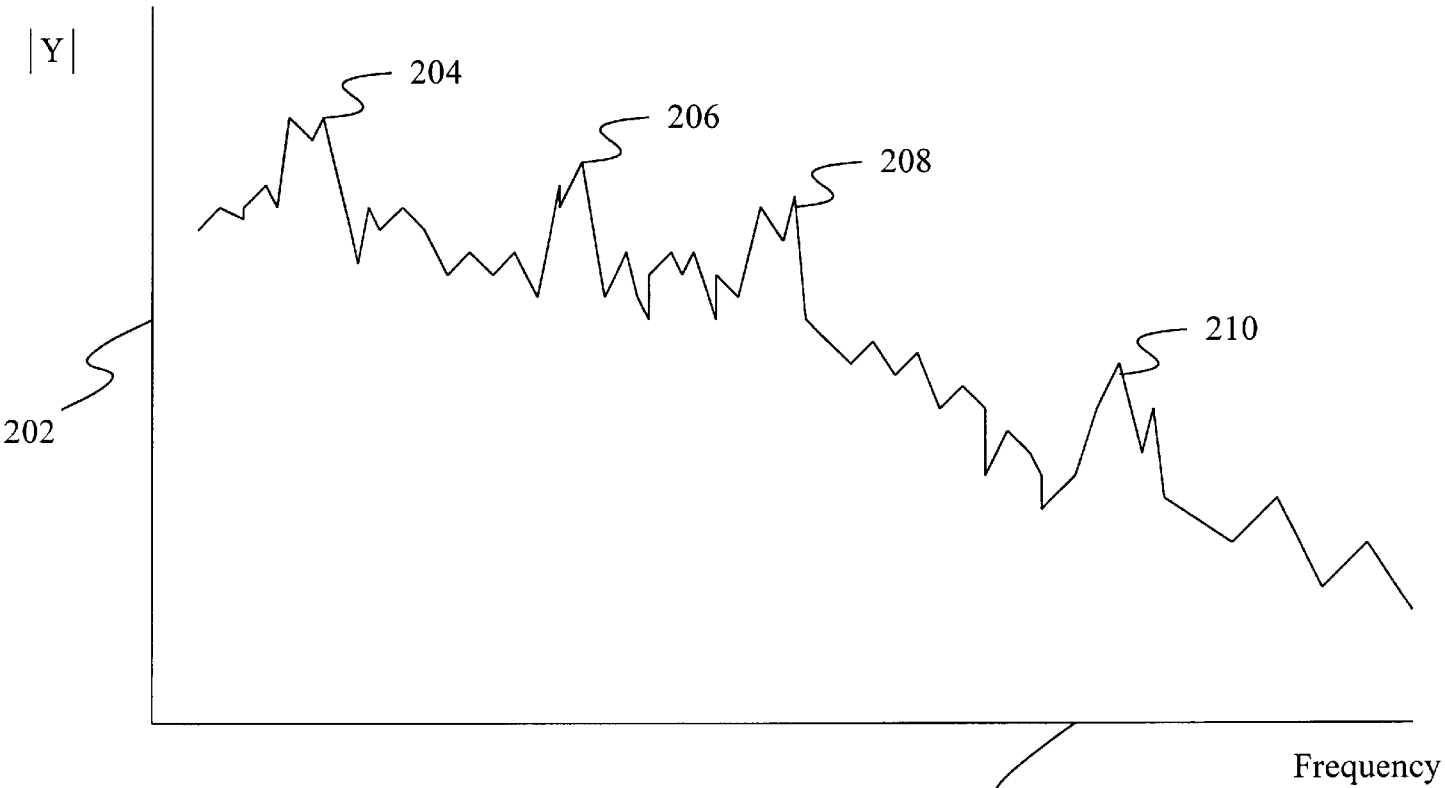
FIG. 2 is a graph of the magnitude spectrum of a speech signal.

FIG. 2 is a graph of the frequency spectrum of a section of human speech. In FIG. 2, frequency is shown along horizontal axis 200 and the magnitude of the frequency components is shown along vertical axis 202. The graph of FIG. 2 shows that human speech contains resonances or formants, such as first formant 204, second formant 206, third formant 208, and fourth formant 210. Each formant is described by its center frequency, F, and its bandwidth, B.

Figure 3:
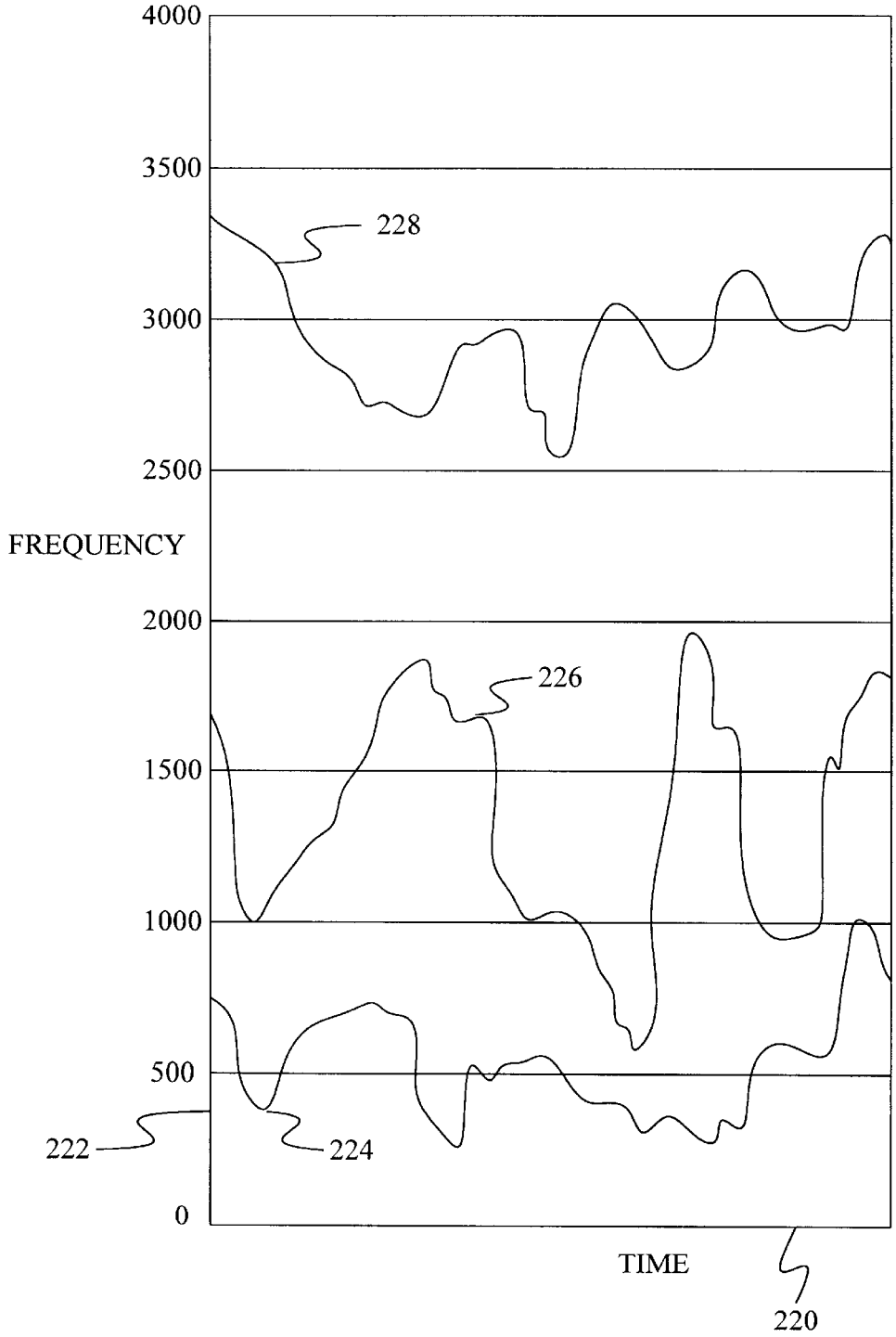
FIG. 3 is a graph of the first three formants of a speech signal.

FIG. 3 is a graph of changes in the center frequencies of the first three formants during a lengthy utterance. In FIG. 3, time is shown along horizontal axis 220 and frequency is shown along vertical axis 222. Solid line 224 traces changes in the frequency of the first formant, F1, solid line 226 traces changes in the frequency of the second formant, F2, and solid line 228 traces changes in the frequency of the third formant, F3. Although not shown, the bandwidth of each formant also changes during an utterance.

Figure 4:
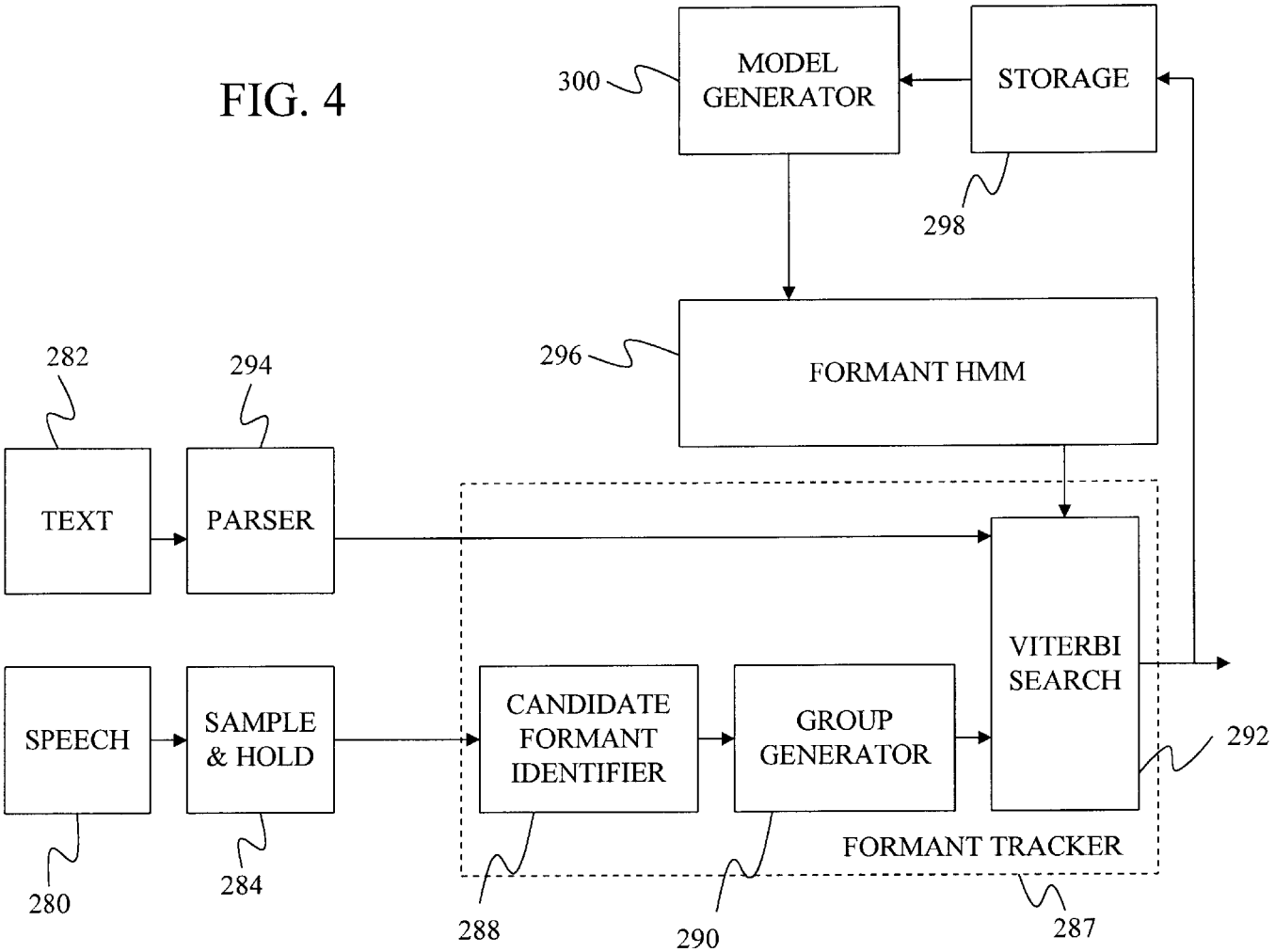
FIG. 4 is a block diagram of a formant tracker and formant model trainer of one embodiment of the present invention.

One embodiment of the present invention for tracking these changes in the formants is shown in the block diagram of FIG. 4. In FIG. 4, input speech 280 is generated by a speaker while reading text 282. Speech 282 is sampled and held by a sample and hold circuit 284, which in one embodiment, samples training speech 282 across successive overlapping Hanning windows.

The sampled values are then passed to a formant tracker 287 that consists of a formant identifier 288, a group generator 290 and a Viterbi search unit 292. Formant identifier 288 receives the sampled values and uses the values to identify possible formants. In one embodiment, formant identifier 288 consists of a Linear Predictive Coding (LPC) unit that determines the roots of the LPC predictor polynomial. Each root describes a possible frequency and bandwidth for a formant. In other embodiments, formants are identified as peaks in the LPC-spectrum. Both of these techniques are well known in the art.

In the prior art, only those candidate formants with sufficiently small bandwidths were used to select the formants for a sampling window. If a candidate formant's bandwidth was too large it was discarded at this stage. In contrast, the present invention retains all candidate formants, regardless of their bandwidth.

The candidate formants produced by formant identifier 288 are provided to a group generator 290, which groups the candidate formants based on their frequencies. In particular, group generator 290 forms unique groups of N candidate formants, with the candidates ordered from lowest frequency to highest frequency within each group. Thus, if N=3 and there are seven candidate formants, the group generator will create 35 3-formant groups.

In most embodiments, N=3, with the lowest frequency candidate designated as the first formant, the second lowest frequency candidate designated as the second formant, and the highest frequency candidate designated as the third formant.

The groups of formant candidates are provided to a Viterbi search unit 292, which is used to identify the most likely sequence of formant groups based on training text 282 and a formant Hidden Markov Model 296. Training text 282 is parsed into sub-word units or states by a parser 294 and the states are provided to Viterbi search unit 292. For example, in embodiments that model phonemes using a left-to-right three-state model, each word is divided into the constituent states of its phonemes and these states are provided to Viterbi search unit 292.

For each state it receives, Viterbi search unit 292 requests a state formant model from Hidden Markov Model 296, which contains a model for each possible state in a language. In one embodiment, the state model contains a mean frequency, a mean bandwidth, a frequency variance and a bandwidth variance for each formant in the model. Thus, for state, i, the state formant model takes the form of a vector, $h_i$, defined as:

$$h_i = \begin{Bmatrix} \mu_{i,F1}, \sigma_{i,F1}, \mu_{i,B1}, \sigma_{i,B1}, \mu_{i,F2}, \sigma_{i,F2}, \\ \mu_{i,B2}, \sigma_{i,B2}, \mu_{i,F3}, \sigma_{i,F3}, \mu_{i,B3}, \sigma_{i,B3} \end{Bmatrix} \quad \text{EQ. 1}$$

where $\mu_{i,Fx}$ is the mean frequency of the xth formant, $$\sigma^2_{i,Fx}$$

is the variance of the xth formant's frequency, $\mu_{i,Bx}$ is the mean bandwidth of the xth formant, $$\sigma^2_{i,Bx}$$

is the variance of the xth formant's bandwidth.

Under one embodiment, in order to provide better smoothing during formant tracking, the state vector shown in Equation 1 is augmented by providing means and variances that describe the slope of change of a formant over time. With the additional means and variances, Equation 1 becomes:

$$h_i = \begin{Bmatrix} \mu_{i,F1}, \sigma_{i,F1}, \mu_{i,B1}, \sigma_{i,B1}, \mu_{i,F2}, \sigma_{i,F2}, \\ \mu_{i,B2}, \sigma_{i,B2}, \mu_{i,F3}, \sigma_{i,F3}, \mu_{i,B3}, \sigma_{i,B3}, \\ \delta_{i,\Delta F1}, \gamma_{i,\Delta F1}, \delta_{i,\Delta B1}, \gamma_{i,\Delta B1}, \delta_{i,\Delta F2}, \gamma_{i,\Delta F2} \\ \delta_{i,\Delta B2}, \gamma_{i,\Delta B2}, \delta_{i,\Delta F3}, \gamma_{i,\Delta F3}, \delta_{i,\Delta B3}, \gamma_{i,\Delta B3} \end{Bmatrix} \quad \text{EQ. 2}$$

where $\delta_{i,\Delta F1}$ and $\gamma_{i\Delta F1}$ are the mean and standard deviation of the change in frequency of the first formant, $\delta_{i,\Delta B1}$ and $\gamma_{i,\Delta B1}$ are the mean and standard deviation of the change in bandwidth of the first formant, $\delta_{i,\Delta F2}$, $\gamma_{i,\Delta F2}$ and $\delta_{i,\Delta B2}$, $\gamma_{i,\Delta B2}$ are the mean and standard deviation of the change in frequency and change in bandwidth, respectively, of the second formant, and $\delta_{i,\Delta F3}$, $\gamma_{i,\Delta F3}$ and $\delta_{i,\Delta B3}$, $\gamma_{i,\Delta B3}$ are the mean and standard deviation of the change in frequency and bandwidth, respectively, of the third formant.

To calculate the most likely sequence of observed formant groups, $\hat{G}$, Viterbi search unit 292 calculates a separate probability for each possible sequence of observed groups:

$$G=\{g_1,g_2,g_3, \ldots g_T\} \quad \text{EQ. 3}$$

where T is the total number of states in the utterance under consideration, and $g_x$ is the frequencies and bandwidths for the formants in a group observed for the xth state. The probability for each observed sequence of formant groups, G, given the HMM λ is defined as:

$$p(G \mid \lambda) = \sum_q p(G \mid q, \lambda) p(q \mid \lambda) \quad \text{EQ. 4}$$

where $p(q|\lambda)$ is the probability of a sequence of states q given the HMM λ, $p(G|q,\lambda)$ is the probability of the sequence of formant groups given the HMM λ and the sequence of states q, and the summation is taken over all possible state sequences:

$$q=\{q_1,q_2,q_3, \ldots q_T\} \quad \text{EQ. 5}$$

In most embodiments, the sequence of states are limited to the sequence, $\hat{q}$, created from the segmentation of training text 282 provided by parser 294. In addition, many embodiments simplify the calculations associated with Equation 4 by replacing the summation with the largest term in the summation. This leads to:

$$\hat{G}=arg_G max[\ln p(G|\hat{q}, \lambda)] \quad \text{EQ. 6}$$

At each state i, the HMM vector of Equation 2 can be divided into two mean vectors $\Theta_i$ and $\Delta_i$, and two covariance matrices $\Sigma_i$ and $\Gamma_i$ defined as:

$$\Theta_i = \begin{Bmatrix} \mu_{i,F1}, \mu_{i,F2}, \mu_{i,F3}, \ldots, \mu_{i,FM/2}, \\ \mu_{i,B1}, \mu_{i,B2}, \mu_{i,B3}, \ldots, \mu_{i,BM/2} \end{Bmatrix} \quad \text{EQ. 7}$$

$$\Delta_i = \begin{Bmatrix} \delta_{i,\Delta F1}, \delta_{i,\Delta F2}, \delta_{i,\Delta F3}, \ldots, \delta_{i,\Delta FM/2}, \\ \delta_{i,\Delta B1}, \delta_{i,\Delta B2}, \delta_{i,\Delta B3}, \ldots, \delta_{i,\Delta BM/2} \end{Bmatrix} \quad \text{EQ. 8}$$

$$\Sigma_i = \begin{pmatrix} \sigma^2_{i,F1} & 0 & 0 & 0 & 0 & 0 & 0 & 0 \\ 0 & \sigma^2_{i,F2} & 0 & 0 & 0 & 0 & 0 & 0 \\ 0 & 0 & \ddots & 0 & 0 & 0 & 0 & 0 \\ 0 & 0 & 0 & \sigma^2_{i,FM/2} & 0 & 0 & 0 & 0 \\ 0 & 0 & 0 & 0 & \sigma^2_{i,B1} & 0 & 0 & 0 \\ 0 & 0 & 0 & 0 & 0 & \sigma^2_{i,B2} & 0 & 0 \\ 0 & 0 & 0 & 0 & 0 & 0 & \ddots & 0 \\ 0 & 0 & 0 & 0 & 0 & 0 & 0 & \sigma^2_{i,BM/2} \end{pmatrix} \quad \text{EQ. 9}$$

$$\Gamma_i = \begin{pmatrix} \gamma^2_{i,\Delta F1} & 0 & 0 & 0 & 0 & 0 & 0 & 0 \\ 0 & \gamma^2_{i,\Delta F2} & 0 & 0 & 0 & 0 & 0 & 0 \\ 0 & 0 & \ddots & 0 & 0 & 0 & 0 & 0 \\ 0 & 0 & 0 & \gamma^2_{i,\Delta FM/2} & 0 & 0 & 0 & 0 \\ 0 & 0 & 0 & 0 & \gamma^2_{i,\Delta B1} & 0 & 0 & 0 \\ 0 & 0 & 0 & 0 & 0 & \gamma^2_{i,\Delta B2} & 0 & 0 \\ 0 & 0 & 0 & 0 & 0 & 0 & \ddots & 0 \\ 0 & 0 & 0 & 0 & 0 & 0 & 0 & \gamma^2_{i,\Delta BM/2} \end{pmatrix} \quad \text{EQ. 10}$$

where M/2 is the number of formants in each group. Although the covariance matrices are shown as diagonal matrices, more complicated covariance matrices are contemplated within the scope of the present invention. Using these vectors and matrices, the model λ provided by HMM 296 for a language with n possible states becomes:

$$\lambda=\{\Theta_1,\Delta_1,\Sigma_1,\Gamma_1,\Theta_2,\Delta_2,\Sigma_2,\Gamma_2,\ldots\Theta_n,\Delta_n,\Sigma_n,\Gamma_n\} \quad \text{EQ. 11}$$

Combining Equations 7 through 11 with Equation 6, the probability of each individual group sequence is calculated as:

$$\ln p(G\mid\hat{q},\lambda)=\begin{pmatrix}-\frac{TM}{2}\ln(2\pi)-\frac{1}{2}\sum_{t=1}^{T}\ln|\Sigma_{q_t}|-\frac{1}{2}\sum_{t=2}^{T}\ln|\Gamma_{q_t}|\\ -\frac{1}{2}\sum_{t=1}^{T}(g_t-\Theta_{q_t})'\Sigma_{q_t}^{-1}(g_t-\Theta_{q_t})\\ -\frac{1}{2}\sum_{t=2}^{T}(g_t-g_{t-1}-\Delta_{q_t})'\Gamma_{q_t}^{-1}(g_t-g_{t-1}-\Delta_{q_t})\end{pmatrix} \quad \text{EQ. 12}$$

where T is the total number of states in the utterance under consideration, M/2 is the number of formants in each group g, $g_t$ is the group observed in the current sampling window t, $g_{t-1}$ is the group observed in the preceding sampling window t−1, (x)' denotes the transpose of matrix x, $\Sigma_{q_t}^{-1}$ indicates the inverse of the matrix $\Sigma_{q_t}$, and the subscript $q_t$ indicates the model vector element of state q, which has been parsed as occurring during sampling window t.

The probability of Equation 12 is calculated for each possible sequence of groups, G, and the sequence with the maximum probability is selected as the most likely sequence of formant groups. Since each formant group contains multiple formants, the calculation of the probability of a sequence of groups found in Equation 12 simultaneously provides probabilities for multiple non-intersecting formant tracks. For example, where there are three formants in a group, the calculations of Equation 12 simultaneously provided the combined probabilities of a first, second and third formant track. Thus, by using Equation 12 to select the most likely sequence of groups, the present invention inherently selects the most likely formant tracks.

In some embodiments, Equation 12 is modified to provide for additional smoothing of the formant tracks. This modification involves allowing Viterbi Search Unit 292 to select formant constituents (i.e. F1, F2, F3, B1, B2, and B3) that are not actually observed. This modification is based in part on the recognition that due to limitations in the monitoring equipment, the observed formant track is not always the same as the real formant track produced by the speaker.

To provide for this modification, a real sequence of formant groups, X, is defined with:

$$X=\{x_1,x_2,x_3,\ldots x_T\} \quad \text{EQ. 13}$$

where $x_i$ is the real formant group (also referred to as the real formant vector) at state i. This changes Equation 12 so that it becomes:

$$\ln p(X\mid\hat{q},\lambda)=\begin{pmatrix}-\frac{TM}{2}\ln(2\pi)-\frac{1}{2}\sum_{t=1}^{T}\ln|\Sigma_{q_t}|-\frac{1}{2}\sum_{t=2}^{T}\ln|\Gamma_{q_t}|\\ -\frac{1}{2}\sum_{t=1}^{T}(x_t-\Theta_{q_t})'\Sigma_{q_t}^{-1}(x_t-\Theta_{q_t})\\ -\frac{1}{2}\sum_{t=2}^{T}(x_t-x_{t-1}-\Delta_{q_t})'\Gamma_{q_t}^{-1}(x_t-x_{t-1}-\Delta_{q_t})\end{pmatrix} \quad \text{EQ. 14}$$

where Equation 14 is now used to find the most probable sequence of real formant groups, $\hat{X}$.

With this modification to Equation 12, an additional smoothing term may be added to account for the difference between the real formants and the observed formants. Specifically, if X is the real set of formant tracks, which is hidden, and $\hat{G}$ is the most probable observed formant tracks selected above, the joint probability of both X and $\hat{G}$ given the Hidden Markov Model λ is defined as:

$$p(\hat{G},X\mid\lambda)=p(\hat{G}\mid X,\lambda)p(\hat{G}\mid\lambda)=p(X\mid\lambda)\prod_{t=1}^{T}p(g_t\mid x_t) \quad \text{EQ. 15}$$

where $p(\hat{G}|X,\lambda)$ is the probability of the most likely observed formant tracks given the real formant tracks and the HMM, $p(X|\lambda)$ is the probability of the real formant tracks given the HMM, and $p(g_t|x_t)$ is the probability of the most likely observed group of formant values at state t given the real group of formant values at state t. In Equation 15 it is assumed that $p(G|X,\lambda)$ does not depend on λ, and that the probability of a group of most likely observed formants in state t, $g_t$, only depends on the group of actual formants at state t, $x_t$.

The probability of a group of most likely observed formant values at state t given the group of real formant values at state t, $p(g_t|x_t)$, can be approximated by a Gaussian density function:

$$p(g_t\mid x_t)=\frac{1}{(2\pi)^{M/2}\prod_{j=1}^{M}\upsilon[j]}\exp\left\{-\frac{1}{2}\sum_{j=1}^{M}\frac{(g[j]-x[j])^2}{\upsilon^2[j]}\right\} \quad \text{EQ. 16}$$

where M is the number of formant constituents in each group, g[j] represents the jth observed formant constituent (i.e. F1, F2, F3, B1, B2, or B3) within the group, x[j] represents the jth real formant constituent within the group, and $\upsilon^2[j]$ is the variance of the jth real formant constituent within the group. In one embodiment, υ[j] of the formant frequency values in group t ($F1_t$, $F2_t$, or $F3_t$) is set equal to the observed bandwidth for the respective formant frequency value. In these embodiments, υ[j] of the formant bandwidth values was set to the formant bandwidth.

Using the far right-hand side of Equation 15, it can be seen that the smoothing equation of Equation 16 can be added to Equation 14 to produce a formant tracking equation that considers unobserved groups of formants. In particular this combination produces:

$$\ln p(X\mid\hat{q},\lambda)=\begin{pmatrix}-\frac{TM}{2}\ln(2\pi)-\frac{1}{2}\sum_{t=1}^{T}\ln|\Sigma_{q_t}|-\frac{1}{2}\sum_{t=2}^{T}\ln|\Gamma_{q_t}|\\ -\frac{1}{2}\sum_{t=1}^{T}(x_t-\Theta_{q_t})'\Sigma_{q_t}^{-1}(x_t-\Theta_{q_t})\\ -\frac{1}{2}\sum_{t=2}^{T}(x_t-x_{t-1}-\Delta_{q_t})'\Gamma_{q_t}^{-1}(x_t-x_{t-1}-\Delta_{q_t})\\ -\frac{1}{2}\sum_{t=1}^{T}(g_t-x_t)'\Psi_t^{-1}(g_t-x_t)\end{pmatrix} \quad \text{EQ. 17}$$

where $\Psi_t$ is a covariance matrix containing the covariance values $\upsilon^2[j]$ for the formant constituents of group t. In one embodiment, $\Psi_t$ is a diagonal matrix of the form:

$$\Psi_i = \begin{pmatrix} \upsilon_{i,F1}^2 & 0 & 0 & 0 & 0 & 0 & 0 & 0 \\ 0 & \upsilon_{i,F2}^2 & 0 & 0 & 0 & 0 & 0 & 0 \\ 0 & 0 & \ddots & 0 & 0 & 0 & 0 & 0 \\ 0 & 0 & 0 & \upsilon_{i,F\frac{M}{2}}^2 & 0 & 0 & 0 & 0 \\ 0 & 0 & 0 & 0 & \upsilon_{i,B1}^2 & 0 & 0 & 0 \\ 0 & 0 & 0 & 0 & 0 & \upsilon_{i,B2}^2 & 0 & 0 \\ 0 & 0 & 0 & 0 & 0 & 0 & \ddots & 0 \\ 0 & 0 & 0 & 0 & 0 & 0 & 0 & \upsilon_{i,B\frac{M}{2}}^2 \end{pmatrix} \quad \text{EQ. 18}$$

If $\Sigma_{q_t}$ and $\Gamma_{q_t}$ are also diagonal matrices, the matrix functions within the last three summations of Equation 17 produces terms of the form:

$$\sum_{t=1}^{T}(x_t - \Theta_{q_t})'\Sigma_{q_t}^{-1}(x_t - \Theta_{q_t}) = \left\{ \begin{array}{l} \frac{(F1_1 - \mu_{1,F1})^2}{\sigma_{1,F1}^2} + \frac{(F1_2 - \mu_{2,F1})^2}{\sigma_{2,F1}^2} + \ldots + \frac{(F1_T - \mu_{T,F1})^2}{\sigma_{T,F1}^2} + \\ \frac{(F2_1 - \mu_{1,F2})^2}{\sigma_{1,F2}^2} + \frac{(F2_2 - \mu_{2,F2})^2}{\sigma_{2,F2}^2} + \ldots + \frac{(F2_T - \mu_{T,F2})^2}{\sigma_{T,F2}^2} + \ldots \\ + \frac{(B3_1 - \mu_{1,B3})^2}{\sigma_{1,B3}^2} + \frac{(B3_2 - \mu_{2,B3})^2}{\sigma_{2,B3}^2} + \ldots + \frac{(B3_T - \mu_{T,B3})^2}{\sigma_{T,B3}^2} \end{array} \right\} \quad \text{EQ. 19}$$

$$\sum_{t=2}^{T}(x_t - x_{t-1} - \Delta_{q_t})'\Gamma_{q_t}^{-1}(x_t - x_{t-1} - \Delta_{q_t}) = \left\{ \begin{array}{l} \frac{(F1_2 - F1_1 - \delta_{1,F1})^2}{\gamma_{1,F1}^2} + \ldots + \frac{(F1_T - F1_{T-1} - \delta_{T,F1})^2}{\gamma_{T,F1}^2} + \ldots \\ \frac{(F2_2 - F2_1 - \delta_{1,F2})^2}{\gamma_{1,F2}^2} + \ldots + \frac{(F2_T - F2_{T-1} - \delta_{T,F2})^2}{\gamma_{T,F2}^2} + \ldots \\ + \frac{(B3_2 - B3_1 - \delta_{1,B3})^2}{\gamma_{1,B3}^2} + \ldots + \frac{(B3_T - B3_{T-1} - \delta_{T,B3})^2}{\gamma_{T,B3}^2} \end{array} \right\} \text{and} \quad \text{EQ. 20}$$

$$\frac{1}{2}\sum_{t=1}^{T}(g_t - x_t)'\Psi_t^{-1}(g_t - x_t) = \left\{ \begin{array}{l} \frac{(g_{1,F1} - F1_1)^2}{\upsilon_{1,F1}^2} + \frac{(g_{2,F1} - F1_2)^2}{\upsilon_{2,F1}^2} + \ldots + \frac{(g_{T,F1} - F1_T)^2}{\upsilon_{T,F1}^2} + \\ \frac{(g_{1,F2} - F2_1)^2}{\upsilon_{1,F2}^2} + \frac{(g_{2,F2} - F2_2)^2}{\upsilon_{2,F2}^2} + \ldots + \frac{(g_{T,F2} - F2_T)^2}{\upsilon_{T,F2}^2} + \ldots \\ + \frac{(g_{1,B3} - B3_1)^2}{\upsilon_{1,B3}^2} + \frac{(g_{2,B3} - B3_2)^2}{\upsilon_{2,B3}^2} + \ldots + \frac{(g_{T,B3} - B3_T)^2}{\upsilon_{T,B3}^2} \end{array} \right\} \quad \text{EQ. 21}$$

where the subscript notations in Equations 19 through 21 can be understood by generalizing the following small set of examples: $F2_1$ is the frequency of the second formant of the first state, $F2_2$ is the frequency of the second formant of the second state, $B3_1$ is the bandwidth of the third formant of the first state, $\mu_{2,F1}$ is the Hidden Markov Model mean frequency for the first formant in the second state, $\sigma_{T,B3}^2$ is the HMM variance for the bandwidth of the third formant in the last state T, $\delta_{1,F2}$ is the HMM mean change in the frequency of the second formant of the first state, $\gamma_{3,F2}^2$ is the HMM variance for the frequency of the second formant for the third state, $g_{2,B3}$ is the observed value for the third formant's bandwidth in the second state, and $\nu_{2,F1}^2$ is the variance for the observed frequency of the first formant in the second state.

Since the sequence of formant groups that maximizes Equation 17 is not limited to observed groups of formants, this sequence can be determined by finding the partial derivatives of Equation 17 for each sequence of formant constituents.

To find the sequence of formant vectors that maximizes equation 17, each constituent (F1, F2, F3, . . . , B1, B2, B3, . . . ) is considered separately. Thus, a sequence of first formant frequency values, F1, is determined, then a sequence of second formant frequency values, F2, is determined and so on ending with a sequence of formant bandwidth values for the last formant. Note that the order in which the constituents are selected is arbitrary and the sequence of formant bandwidth values for the last formant may be calculated first.

For each constituent (F1, F2, F3, B1, B2, or B3), the sequence of values that maximizes Equation 17 is determined by determining the partial derivatives of Equation 17 with reference to the constituent in each state. Thus, if the sequence of first formant frequencies, F1, is being determined, the partial derivative of Equation 17 is calculated for each $F1_i$ across all states, i, of the input speech signal. In other words, the following partial derivatives are taken:

$$\frac{\delta}{\delta FI_1} f(\text{EQ. } 17),\ \frac{\delta}{\delta FI_2} f(\text{EQ. } 17),\ \ldots,\ \frac{\delta}{\delta FI_T} f(\text{EQ. } 17) \qquad \text{EQ. 22}$$

where δ of Equation 22 refers only to the partial derivative of f(EQ. 17) and is not to be confused with the mean of the change in frequency or bandwidth found in the Hidden Markov Model above.

Each partial derivative associated with a constituent is then set equal to zero. This produces a set of linear equations for each constituent. For example, the linear equation for the partial derivative with reference to the first formant frequency of the second state, $F1_2$, is:

$$\frac{\delta}{\delta FI_2} f(\text{EQ. } 17) = -\frac{1}{\gamma_{q2}^2} FI_1 + \left(\frac{1}{\upsilon_2^2} + \frac{1}{\sigma_{q2}^2} + \frac{1}{\gamma_{q2}^2} + \frac{1}{\gamma_{q3}^2}\right) FI_2 - \frac{1}{\gamma_{q2}^2} FI_3 - \frac{g_{2,F1}}{\upsilon_2^2} - \frac{\mu_{q2}}{\sigma_{q2}^2} - \frac{\delta_{q2}}{\gamma_{q2}^2} + \frac{\delta_{q3}}{\gamma_{q3}} = 0 \qquad \text{EQ. 23}$$

where $g_{2,F1}$ represents the most likely observed value for the first formant at the second state.

The linear equations for a constituent such as F1 can be solved simultaneously using a matrix notation of the form:

$$BX=c \qquad \text{EQ. 24}$$

where B and c are matrices formed by the partial derivatives and X is a matrix containing the constituent's values at each state. The size of B and c depends on the number of states, T, in the speech signal being analyzed. As a simple example of the types of values in B, c, and X, a small utterance of T=3 states would produce matrices of:

$$B = \begin{pmatrix} \frac{1}{\upsilon_1^2} + \frac{1}{\sigma_{q1}^2} + \frac{1}{\gamma_{q2}^2} & -\frac{1}{\gamma_{q2}^2} & 0 \\ -\frac{1}{\gamma_{q2}^2} & \frac{1}{\upsilon_2^2} + \frac{1}{\sigma_{q2}^2} + \frac{1}{\gamma_{q2}^2} + \frac{1}{\gamma_{q3}^2} & -\frac{1}{\gamma_{q3}^2} \\ 0 & -\frac{1}{\gamma_{q3}^2} & \frac{1}{\upsilon_3^2} + \frac{1}{\sigma_{q3}^2} + \frac{1}{\gamma_{q3}^2} \end{pmatrix} \qquad \text{EQ. 25}$$

$$c = \left(\frac{g_1}{\upsilon_1^2} + \frac{\mu_{q1}}{\sigma_{q1}^2} - \frac{\delta_{q2}}{\gamma_{q2}^2}\ \ \frac{g_2}{\upsilon_2^2} + \frac{\mu_{q2}}{\sigma_{q2}^2} + \frac{\delta_{q2}}{\gamma_{q2}^2} - \frac{\delta_{q3}}{\gamma_{q3}^2}\ \ \frac{g_3}{\upsilon_3^2} + \frac{\mu_{q3}}{\sigma_{q3}^2} + \frac{\delta_{q3}}{\gamma_{q3}^2}\right) \qquad \text{EQ. 26}$$

$$X = \begin{pmatrix} FI_1 \\ FI_2 \\ FI_3 \end{pmatrix} \qquad \text{EQ. 27}$$

Note that B is a tridiagonal matrix where all of the values are zero except those in the main diagonal and its two adjacent diagonals. This remains true regardless of the number of states in the output speech signal. The fact that B is a tridiagonal matrix is helpful under many embodiments of the invention because there are well known algorithms that can be used to invert matrix B much more efficiently than a standard matrix.

To solve for the sequence of values for a constituent (F1, F2, F3, B1, B2, or B3), the inverse of B is multiplied by c. This produces the sequence of values that has a maximum probability.

This process is then repeated for each constituent to produce a single most likely sequence of values for each formant constituent in the utterance being analyzed.

TRAINING A FORMANT MODEL

The formant tracking system described above can be used alone or as part of a system for training a formant model. Note that in the discussion above it was assumed that there was a formant Hidden Markov Model defined for each state. However, when training the formant Model for the first time, this is not true. To overcome this problem, the present invention provides an initial simplistic Hidden Markov Model. In one embodiment, the values for this initial HMM are chosen based on average formant values across all possible states in a language. In one particular embodiment, each state, i, has the same initial vector values of:

$$\mu_{i,F1}=500\ Hz \qquad \text{EQ. 28}$$

$$\mu_{i,F2}=1500\ Hz \qquad \text{EQ. 29}$$

$$\mu_{i,F3}=2500\ Hz \qquad \text{EQ. 30}$$

$$\sigma_{i,F1}=\sigma_{i,F2}=\sigma_{i,F3}=500\ Hz \qquad \text{EQ. 31}$$

$$\mu_{i,B1}=\mu_{i,B2}=\mu_{i,B3}=100\ Hz \qquad \text{EQ. 32}$$

$$\sigma_{i,B1}=\sigma_{i,B2}=\sigma_{i,B3}=100\ Hz \qquad \text{EQ. 33}$$

$$\delta_{i,\Delta F1}=\delta_{i,\Delta F2}=\delta_{i,F3}=\delta_{i,\Delta B1}=\delta_{i,\Delta B2}=\delta_{i,\Delta B3}=0\ Hz \qquad \text{EQ. 34}$$

$$\gamma_{i,\Delta F1}=\gamma_{i,\Delta F2}=\gamma_{i,\Delta F3}=\gamma_{i,\Delta B1}=\gamma_{i,\Delta B2}=\gamma_{i,\Delta B3}=100\ Hz \qquad \text{EQ. 35}$$

Using these initial values, a training speech signal is processed by Viterbi search unit 292, to produce an initial set of most likely formants for each state of the training signal. This initial set of formants includes a frequency and bandwidth for each formant. The formant values in this initial set are stored in a storage unit 298, which is later accessed by a model building unit 300.

Model building unit 300 collects the formants associated with each occurrence of a state in the speech signal and combines these formants to generate a distribution of formants for the state. For example, if a state appeared five times in the speech signal, model building unit 300 would combine the formants from the five appearances of the state to form a distribution for each formant. In one embodiment, this distribution is characterized as a Gaussian distribution, which is described by its mean and variance.

For any one formant in a state, several distributions are determined. In one particular embodiment, four distributions are created for each formant in each state. Specifically, distributions are calculated for the formant's frequency, bandwidth, change in frequency, and change in bandwidth. Thus, model building unit 300 determines the mean and variance of the frequency, bandwidth, change in frequency and change in bandwidth for each formant in each possible state in the language.

The formant Hidden Markov Model calculated by model building unit 300 is then designated as the new Hidden Markov Model 296. Training speech 280 is then sampled again and the most likely sequence of formant groups is re-calculated using the new HMM. This process of determining a most likely sequence of formant groups and generating a new Hidden Markov Model is repeated until the formant Hidden Markov Model does not change significantly between iterations. In some embodiments, it has been found that three iterations are sufficient.

COMPRESSING SPEECH SIGNALS

In many applications, such as audio delivery over the Internet, it is advantageous to compress speech signals so that they are accurately represented by as few values as possible. One aspect of the present invention is to use the formant tracking system described above to generate small representations of speech.

Figure 5:
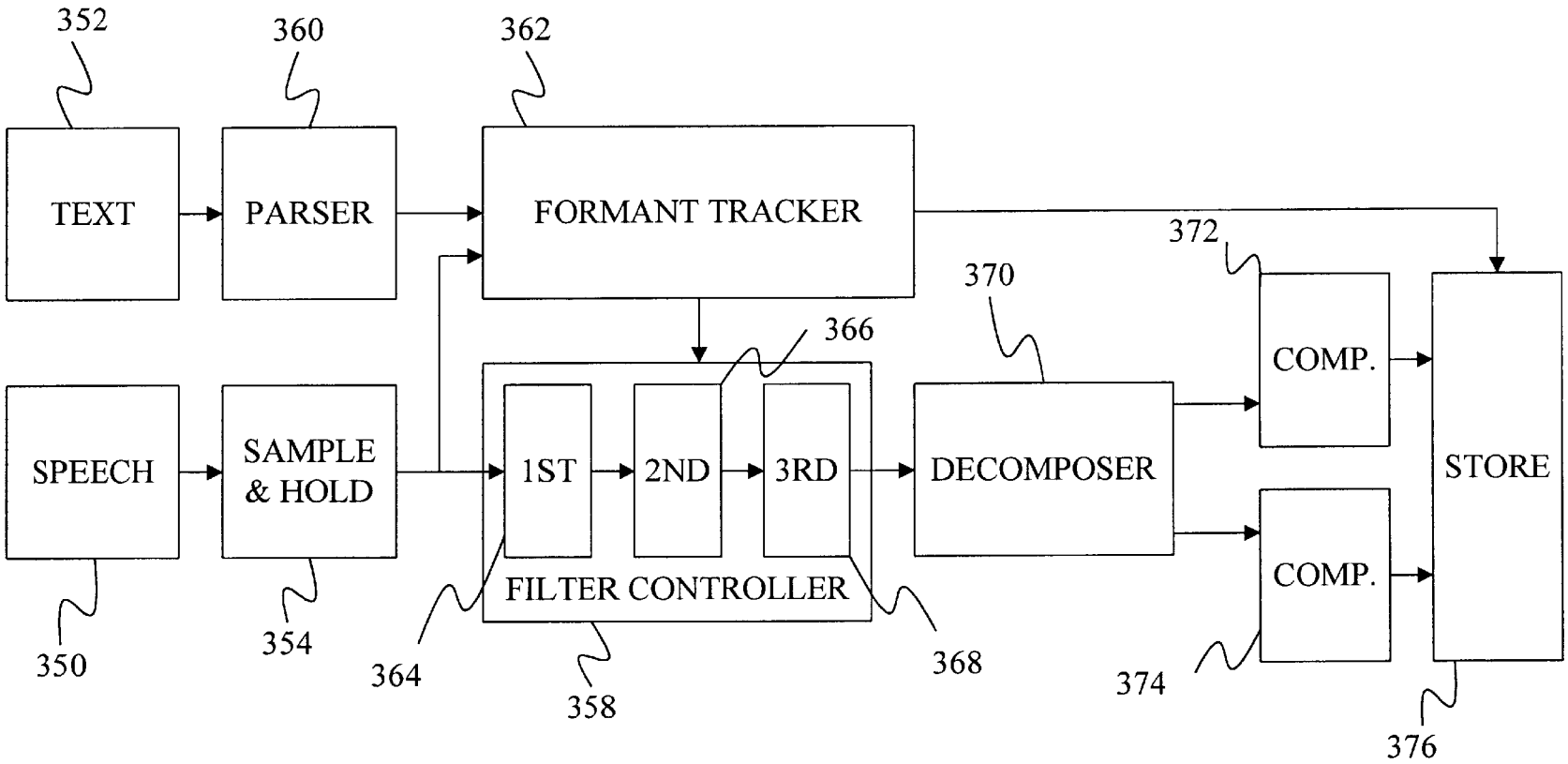
FIG. 5 is a block diagram of a speech compression unit of one embodiment of the present invention.

FIG. 5 is a block diagram of one embodiment of the present invention for compressing speech. In FIG. 5, training speech 350 is generated by a speaker while reading training text 352. Training speech 350 is sampled and held by a sample and hold circuit 354. In one embodiment, sample and hold circuit 354 samples training speech 350 across successive overlapping Hanning windows.

The set of samples is provided to a formant tracker 362, which is the same as formant tracker 287 of FIG.4. Formant tracker 362 also receives text 352 after it has been segmented into HMM states by a parser 360. For each state received from parser 360, formant tracker 362 identifies a set of most likely formants using the techniques described above for formant tracking under the present invention.

The frequencies and bandwidths of the identified formants are provided to a filter controller 358, that also receives the speech samples produced by sample and hold circuit 354. Filter controller 358 aligns the speech samples of a state with the formants identified for that state by formant tracker 362.

With the samples properly aligned, one sample at a time is passed though a series of filters 364, 366, and 368 that are adjusted by filter controller 358. Filter controller 358 adjusts these filters based on the frequency and bandwidth of the respective formants identified for this state by formant tracker 362. In particular, first formant filter 364 is adjusted so that it filters out a set of frequencies centered on the first formant's frequency and having a bandwidth equal to the first formant's bandwidth. Similar adjustments are made to second formant filter 366 and third formant filter 368 so that their center frequencies and bandwidths match the respective frequencies and bandwidths of the second and third formants identified for the state by formant tracker 362.

Figure 6A:
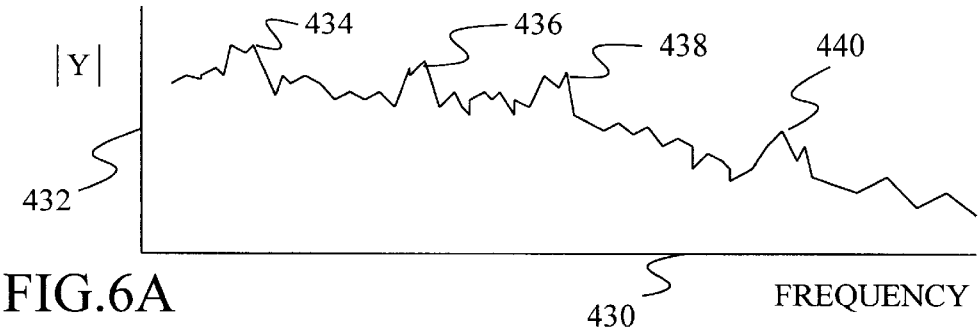
FIG. 6A is a graph of the magnitude spectrum of a speech signal.
Figure 6B:
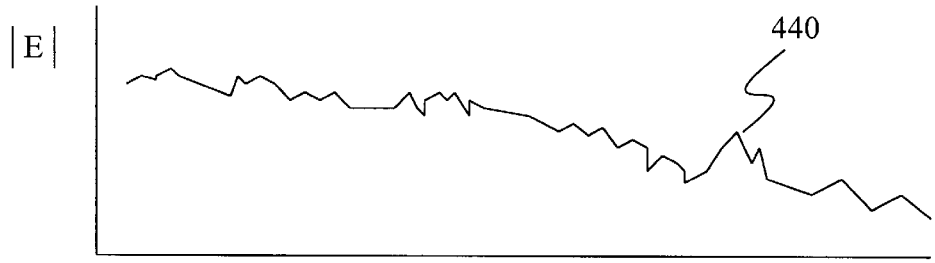
FIG. 6B is a graph of the magnitude spectrum of a speech signal with its formants removed.

With the three formant filters adjusted, the sample values for the current sampling window are passed through the three filters in series. This causes the first, second and third formants to be filtered out of the current sampling window. The effects of this sampling can be seen in FIGS. 6A and 6B. In FIG. 6A, the magnitude spectrum of a current sampling window for speech signal Y, is shown with the frequency components shown along horizontal axis 430 and the magnitude of each component shown along vertical axis 432. Four formants, 434, 436, 438, and 440 are present in FIG. 6A and appear as localized peaks. FIG. 6B shows the magnitude spectrum of the excitation signal that is provided at the output of third formant filter 368 of FIG. 5. Note that in FIG. 6B, first formant 434, second formant 436 and third formant 438 have been removed but fourth formant 440 is still present.

The excitation signal produced at the output of third formant filter 368 is provided to a voiced/unvoiced decomposer 370, which separates the voiced portion of the excitation signal from the unvoiced portion. In one embodiment, decomposer 370 separates the two signals by identifying the pitch period of the excitation signal. Since voiced portions of the signal are formed from waveforms that repeat at the pitch period, the identified pitch period can be used to determine the shape of the repeating waveform. Specifically, successive sections of the excitation signal that are separated by the pitch period can be averaged together to form the voiced portion of the excitation signal. The unvoiced portion can then be determined by subtracting the voiced portion from the excitation signal.

In other embodiments, each frequency component of the excitation signal is tracked over time to provide a time-based signal for each component. Since the voiced portion of the excitation signal is formed by portions of the vocal tract that change slowly over time, the frequency components of the voiced portion should also change slowly over time. Thus, to extract the voiced portion, the time-based signals of each frequency component are low-pass filtered to form smooth traces. The values along the smooth traces then represent the voiced portion's frequency components over time. By subtracting these values from the frequency components of the excitation signal as a whole, the decomposer extracts the frequency component of the unvoiced component. This filtering technique is discussed in more detail in pending U.S. patent application Ser. No. 09/198,661, filed on Nov. 24, 1998 and entitled METHOD AND APPARATUS FOR SPEECH SYNTHESIS WITH EFFICIENT SPECTRAL SMOOTHING, which is hereby incorporated by reference.

Figure 6C:
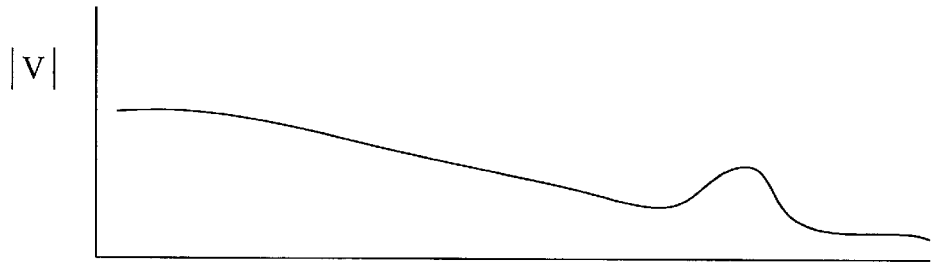
FIG. 6C is a graph of the magnitude spectrum of a voiced portion of the signal of FIG. 6B.
Figure 6D:
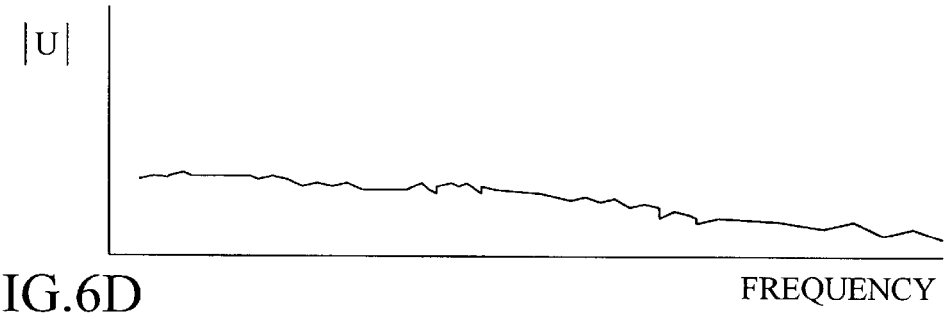
FIG. 6D is a graph of the magnitude spectrum of an unvoiced portion of the signal of FIG. 6B.

FIGS. 6C and 6D show the result of the decomposition performed by decomposer 370 of FIG. 5. FIG. 6C shows the magnitude spectrum of the voiced portion of the excitation signal and FIG. 6D shows the magnitude spectrum of the unvoiced portion.

Figure 7A:
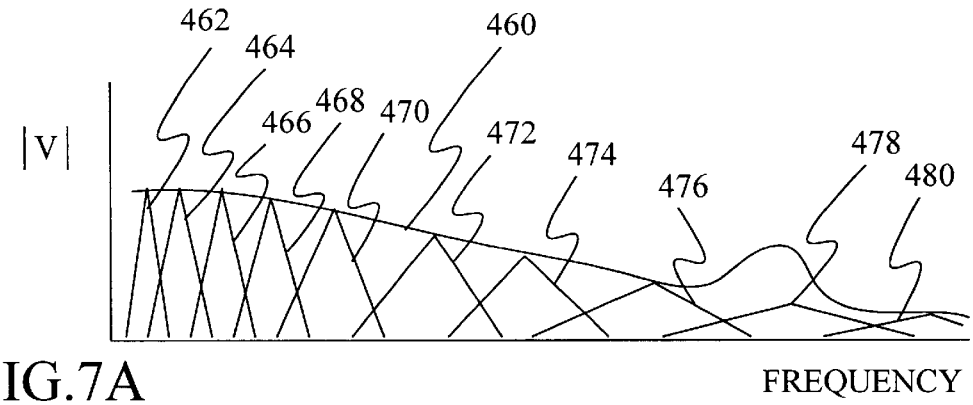
FIG. 7A is a graph of the magnitude spectrum of a voiced portion of a speech signal showing a set of compression triangles.
Figure 7B:
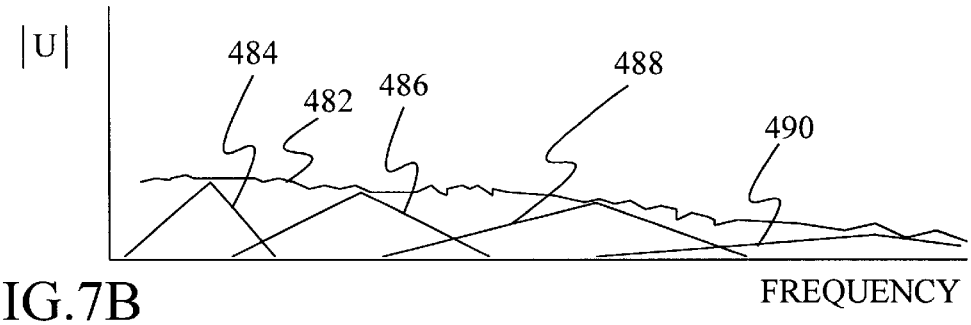
FIG. 7B is a graph of the magnitude spectrum of an unvoiced portion of a speech signal showing a set of compression triangles.

The magnitude spectrum of the voiced portion of the excitation signal is routed to a compression unit 372 in FIG. 5 and the magnitude spectrum of the unvoiced portion is routed to a compression unit 374. Compression units 372 and 374 compress the magnitude spectrums of the voiced component and unvoiced component into a smaller set of values. In one embodiment, this compression involves using overlapping triangles to approximate the magnitude spectrum of each portion. FIGS. 7A and 7B show graphs depicting this approximation. In FIG. 7A, magnitude spectrum 460 of the voiced portion is shown as being approximated by ten overlapping triangles, 462, 464, 466, 468, 470, 472, 474, 476, 478, and 480. The location and width of these triangles is the same for each sampling window of the speech signal. Thus, only the peak values need to be recorded to represent the magnitude spectrum of the voiced portion. FIG. 7B shows a similar graph with magnitude spectrum 482 of the unvoiced portion being approximated by four overlapping triangles 484, 486, 488, and 490. Thus, using compression units 372 and 374, the voiced portion of each sampling window is represented by ten values and the unvoiced portion is represented by four values.

The values output by compression units 372 and 374 are placed in a storage unit 376, which also receives the frequencies and bandwidths of the first three formants produced by formant tracker 362 for this sampling window. Alternatively, these values can be transmitted to a remote location. In one embodiment, the values are transmitted across the Internet.

Note that the phase of both the voiced component and the unvoiced component can be ignored. The present inventors have found that the phase of the voiced component can be adequately approximated by a constant phase across all frequencies without detrimentally affecting the re-creation of the speech signal. It is believed that this approximation is sufficient because most of the significant phase information in a speech signal is contained in the formants. As such, eliminating the phase information in the voiced portion of the excitation signal does not significantly diminish the audio quality of the recreated speech.

The phase of the unvoiced component has been found to be mostly random. As such, the phase of the unvoiced component is approximated by a random number generator when the speech is recreated.

From the discussion above, it can be seen that the present invention is able to compress each sampling window of speech into twenty values. (Ten values describe the magnitude spectrum of the voiced component, four values describe the magnitude spectrum of the unvoiced component, three values describe the frequencies of the first three formants, and three values describe the bandwidths of the first three formants.) This compression reduces the amount of information that must be stored to recreate a speech signal.

Figure 8:
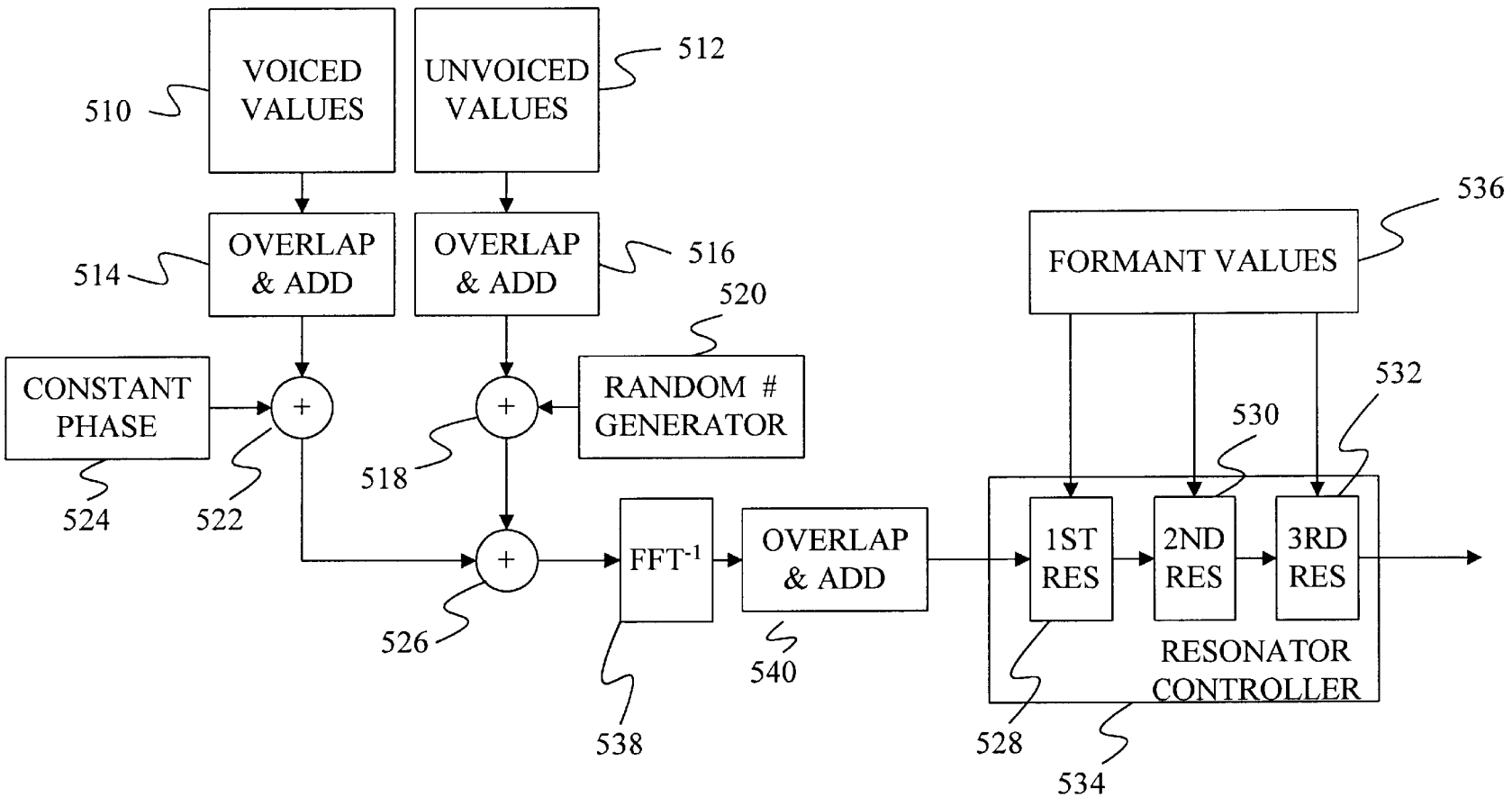
FIG. 8 is a block diagram of a system for reconstructing a speech signal under one embodiment of the present invention.

FIG. 8 is a block diagram of a system for recreating a speech signal that has been compressed using the embodiment of FIG. 5. In FIG. 8, the compressed magnitude values of the voiced portion 510 and unvoiced portion 512 are provided to two overlap-and-add circuits 514 and 516. These circuits recreate approximations of the voiced portion and unvoiced portion, respectively, of the current sampling window. To do this, the circuits sum the overlapping portions of the triangles represented by the compressed voiced values and the compressed unvoiced values.

The output of overlap-and-add circuit 516 is provided to a summing circuit 518 that adds in the phase spectrum of the unvoiced portion of the excitation signal. As noted above, the phase spectrum of the unvoiced portion can be approximated by random values. In FIG. 8, these values are provided by a random number generator 520.

The output of overlap and add circuit 518 is provided to a summing circuit 522, which adds in the phase spectrum of the voiced portion of the excitation signal. As noted above, the phase spectrum of the voiced component can be approximated by a constant value 524, for all frequencies.

After the phase spectrums of the voiced and unvoiced portions have been added to the recreated magnitude spectrums, the recreated voiced and unvoiced portions are summed together by a summing circuit 526. The output of summing circuit 526 represents the Fourier Transform of a recreated excitation signal. An inverse Fast Fourier Transform 538 is performed on this signal to produce one window of the recreated excitation signal. A succession of these windows is then combined by an overlap-and-add circuit 540 to produce the recreated excitation signal. The excitation signal is then passed through three formant resonators 528, 530, and 532.

Each of the resonators is controlled by a resonator controller 534, which sets the resonators based on the stored frequencies and bandwidths 536 for the first three formants. Specifically, resonator controller 534 sets resonators 528, 530 and 532 so that they resonate at the frequency and bandwidth of the first formant, the second formant and the third formant, respectively. The output of resonator 532 represents the recreated speech signal.

SPEECH SYNTHESIS USING A FORMAT HMM

Figure 9:
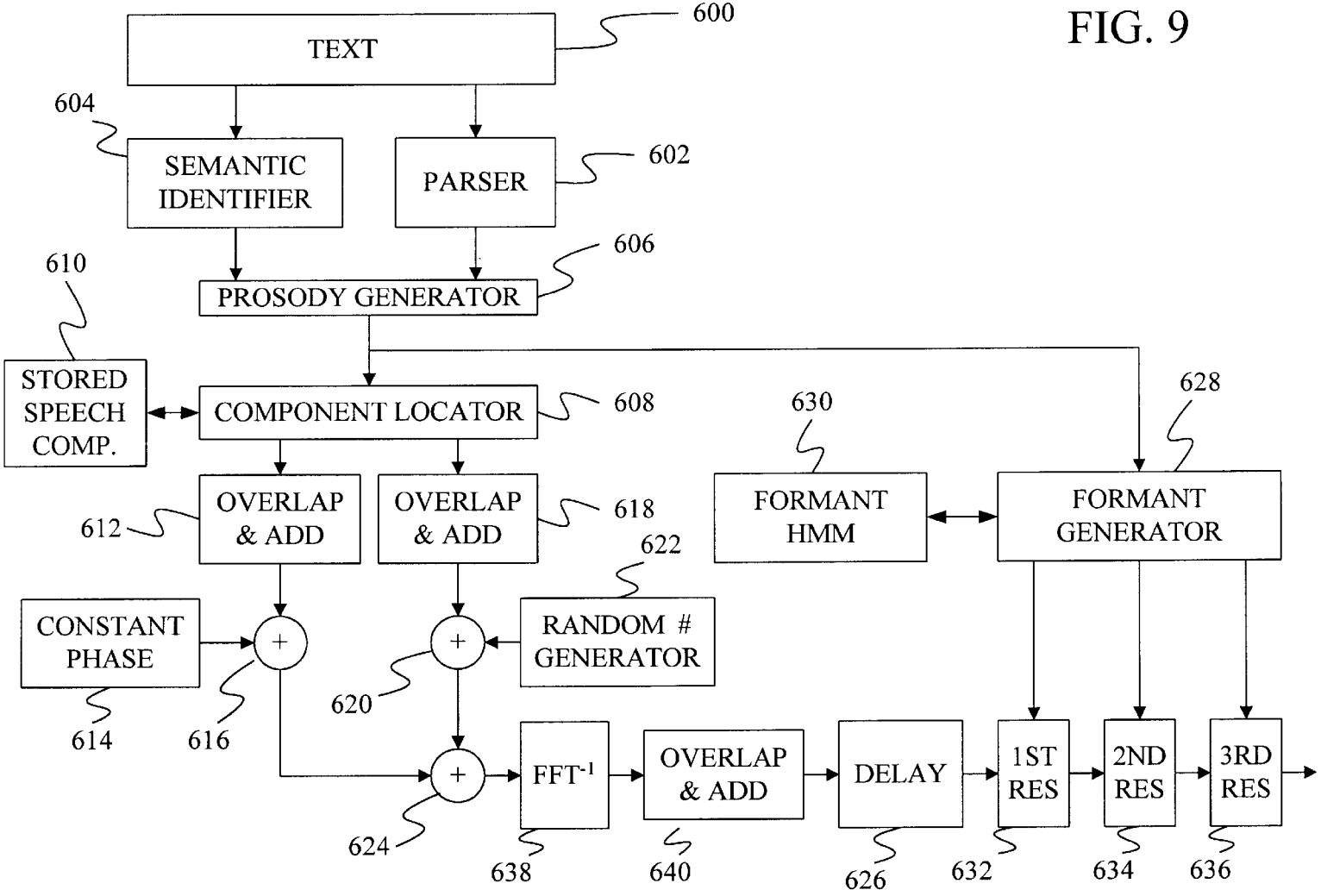
FIG. 9 is a block diagram of a speech synthesis system of one embodiment of the present invention.

Another aspect of the present invention is the synthesis of speech using a formant Hidden Markov Model like the one trained above. FIG. 9 provides a block diagram of one embodiment of such a speech synthesizer under the present invention.

In FIG. 9, text 600 that is to be converted into speech is provided to a parser 602 and a semantic identifier 604. Parser 602 segments the input text into sub-word units and provides these units to a prosody generator 606. In one embodiment, the sub-word units are states of the formant Hidden Markov Model.

Semantic identifier 604 examines the text to determine its linguistic structure. Based on the text's structure, semantic identifier 604 generates a set of prosody marks that indicate which parts of the text are to be emphasized. These prosody marks are provided to prosody generator 606, which uses the marks in determining the pitch and cadence for the synthesized speech.

To generate the proper pitch and cadence for the synthesized speech, prosody generator 606 controls the rate at which it releases the states it receives from parser 602. In addition, by repeatedly releasing a single state it receives from parser 602, prosody generator 606 is able to extend the duration of the sound associated with that state. To extend the duration of a particular sound, prosody generator 606 also has the ability to repeatedly release a single state it receives from parser 602. To increase the pitch of a phoneme, prosody calculator 606 reduces the time period between successive HMM states at its output. This causes more waveforms to be generated during a period of time, thereby increasing the pitch of the speech signal.

Based on the HMM states provided by prosody calculator 606, component locator 608 locates compressed values for the magnitude spectrums of the voiced and unvoiced portions of the speech signal. These compressed values are stored in a component storage area 610, which was created during a training speech session that determined the average magnitude spectrums for each HMM state. In one embodiment, these compressed values represent the magnitude of overlapping triangles as discussed above in connection with the re-creation of a speech signal.

The compressed magnitude spectrum values for the voiced portion of the speech signal are combined by an overlap-and-add circuit 612. This produces an estimate of the magnitude spectrum values for the voiced portion of the speech signal. These estimated magnitude values are then combined with a set of constant phase spectrum values 614 by a summing circuit 616. As discussed above, the same phase value can be used across all frequencies of the voiced portion without significantly impacting the output speech signal. The combination of the magnitude and phase spectrums provides an estimate of the voiced portion of the speech signal.

The compressed magnitude spectrum values for the unvoiced component are provided to an overlap-and-add circuit 618, which combines the triangles represented by the spectrum values to produce an estimate of the unvoiced portion's magnitude spectrum. This estimate is provided to a summing circuit 620, which combines the estimated magnitude spectrum with a random phase spectrum that is provided by a random noise generator 622. As discussed above, random phase values can be used for the phase of the unvoiced portion without impacting the quality of the output speech signal. The combination of the phase and magnitude spectrums provides an estimate of the unvoiced portion of the speech signal.

The estimates of the voiced and unvoiced portions of the speech signal are combined by a summing circuit 624 to provide a Fourier Transform estimate of an excitation signal for the speech signal. The Fourier Transform estimate is passed through an inverse Fast Fourier Transform 638 to produce a series of windows representing portions of the excitation signal. The windows are then combined by an overlap-and-add circuit 640 to produce the estimate of the excitation signal. This excitation signal is then passed through a delay unit 626 to align it with a set of formants that are calculated by a formant path generator 628.

In one embodiment, formant path generator 628 calculates a most likely formant track for the first three formants in the speech signal. To do this, one embodiment of formant path generator 628 relies on the HMM states provided by prosody calculator 606 and a formant HMM 630. The algorithm for generating the most likely formant tracks for a synthesized speech signal is similar to the technique described above for detecting the most likely formant tracks in an input speech signal.

Specifically, the formant path generator determines a most likely sequence of formant vectors given the Hidden Markov Model and the sequence of states from prosody calculator 606. Each sequence of possible formant vectors is defined as:

$$X=\{x_1,x_2,x_3,\ldots x_T\} \quad \text{EQ. 36}$$

where T is the total number of states in the utterance being constructed, and $x_i$ is the formant vector for the ith state. In Equation 36, each formant vector is defined as:

$$x_i=\{F1_i,F2_i,F3_i,B1_i,B2_i,B3_i\} \quad \text{EQ. 37}$$

where $F1_i$, $F2_i$, and $F3_i$, are the first, second and third formant's frequencies and $B1_i$, $B2_i$, and $B3_i$, are the first, second and third formant's bandwidths for the ith state of the speech signal.

Ignoring the sequence of states provided by prosody calculator 606 for the moment, the probability for each sequence of formant vectors, X, given a HMM, λ, is defined as:

$$p(X \mid \lambda) = \sum_q p(X \mid q, \lambda)p(q \mid \lambda) \quad \text{EQ. 38}$$

where p(q|λ) is the probability of a sequence of states q given the HMM λ, p(X|q,λ) is the probability of the sequence of formant vectors given the HMM λ and the sequence of states q, and the summation is taken over all possible state sequences:

$$q=\{q_1,q_2,q_3,\ldots q_T\} \quad \text{EQ. 39}$$

Although detecting the most likely sequence of states using Equation 38 would in theory provide the most accurate speech signal, in most embodiments, the sequence of states are limited to the sequence, q̂, created by prosody calculator 606. In addition, many embodiments simplify the calculations associated with Equation 38 by replacing the summation with the largest term in the summation. This leads to:

$$\hat{X}=arg_x max[ln\ p(X|\hat{q},\lambda)] \quad \text{EQ. 40}$$

As in the formant tracking discussion above, at each state, i, of the synthesized speech signal, the HMM vector of Equation 2 can be divided into two mean vectors $\Theta_i$, and $\Delta_i$, and two covariance matrices $\Sigma_i$ and $\Gamma_i$ defined as:

$$\Theta_i = \begin{Bmatrix} \mu_{i,F1}, \mu_{i,F2}, \mu_{i,F3}, \ldots, \mu_{i,FM/2}, \\ \mu_{i,B1}, \mu_{i,B2}, \mu_{i,B3}, \ldots, \mu_{i,BM/2} \end{Bmatrix} \quad \text{EQ. 41}$$

$$\Delta_i = \begin{Bmatrix} \delta_{i,\Delta F1}, \delta_{i,\Delta F2}, \delta_{i,\Delta F3}, \ldots, \delta_{i,\Delta FM/2}, \\ \delta_{i,\Delta B1}, \delta_{i,\Delta B2}, \delta_{i,\Delta B3}, \ldots, \delta_{i,\Delta BM/2} \end{Bmatrix} \quad \text{EQ. 42}$$

-continued $$\Sigma_i = \begin{pmatrix} \sigma^2_{i,F1} & 0 & 0 & 0 & 0 & 0 & 0 & 0 \\ 0 & \sigma^2_{i,F2} & 0 & 0 & 0 & 0 & 0 & 0 \\ 0 & 0 & \ddots & 0 & 0 & 0 & 0 & 0 \\ 0 & 0 & 0 & \sigma^2_{i,FM/2} & 0 & 0 & 0 & 0 \\ 0 & 0 & 0 & 0 & \sigma^2_{i,B1} & 0 & 0 & 0 \\ 0 & 0 & 0 & 0 & 0 & \sigma^2_{i,B2} & 0 & 0 \\ 0 & 0 & 0 & 0 & 0 & 0 & \ddots & 0 \\ 0 & 0 & 0 & 0 & 0 & 0 & 0 & \sigma^2_{i,BM/2} \end{pmatrix} \quad \text{EQ. 43}$$

$$\Gamma_i = \begin{pmatrix} \gamma^2_{i,\Delta F1} & 0 & 0 & 0 & 0 & 0 & 0 & 0 \\ 0 & \gamma^2_{i,\Delta F2} & 0 & 0 & 0 & 0 & 0 & 0 \\ 0 & 0 & \ddots & 0 & 0 & 0 & 0 & 0 \\ 0 & 0 & 0 & \gamma^2_{i,\Delta FM/2} & 0 & 0 & 0 & 0 \\ 0 & 0 & 0 & 0 & \gamma^2_{i,\Delta B1} & 0 & 0 & 0 \\ 0 & 0 & 0 & 0 & 0 & \gamma^2_{i,\Delta B2} & 0 & 0 \\ 0 & 0 & 0 & 0 & 0 & 0 & \ddots & 0 \\ 0 & 0 & 0 & 0 & 0 & 0 & 0 & \gamma^2_{i,\Delta BM/2} \end{pmatrix} \quad \text{EQ. 44}$$

where M/2 is the number of formants in each group, with M=6 in most embodiments. Although the covariance matrices are shown as diagonal matrices, more complicated covariance matrices are contemplated within the scope of the present invention. Using these vectors and matrices, the model λ provided by formant HMM 630 for a language with n possible states becomes:

$$\lambda=\{\Theta_1,\Delta_1,\Sigma_1,\Gamma_1,\Theta_2,\Delta_2,\Sigma_2,\Gamma_2,\ldots \Theta_n, \Delta_n,\Sigma_n,\Gamma_n\} \quad \text{EQ. 45}$$

Combining Equations 41 through 45 with Equation 40, the probability of each individual sequence of formant vectors is calculated as:

$$\ln p(X \mid \hat{q}, \lambda) = \begin{pmatrix} -\frac{TM}{2}\ln(2\pi) - \frac{1}{2}\sum_{t=1}^{T}\ln|\Sigma_{q_t}| - \frac{1}{2}\sum_{t=2}^{T}\ln|\Gamma_{q_t}| \\ -\frac{1}{2}\sum_{t=1}^{T}(x_t - \Theta_{q_t})'\Sigma^{-1}_{q_t}(x_t - \Theta_{q_t}) \\ -\frac{1}{2}\sum_{t=2}^{T}(x_t - x_{t-1} - \Delta_{q_t})'\Gamma^{-1}_{q_t}(x_t - x_{t-1} - \Delta_{q_t}) \end{pmatrix} \quad \text{EQ. 46}$$

where T is the total number of states or output windows in the utterance being synthesized, M/2 is the number of formants in each formant vector x, $x_t$ is the formant vector in the current output window t, $x_{t-1}$ is the formant vector in the preceding output window t−1, (y)' denotes the transpose of matrix y, $\Sigma_{q_i}^{-1}$ indicates the inverse of the matrix $\Sigma_{q_i}$, and the subscript $q_t$ indicates the HMM element of state q, which has been assigned to output window t. Note that in many embodiments, the formant tracks are selected on a sentence basis so the number of states T is the number of states in the current sentence being constructed.

To find the sequence of formant vectors that maximizes equation 46, the partial derivative technique described above for Equation 17 is applied to Equation 46. This results in linear equations that can be represented by the matrix equation BX=C as discussed further above. Examples of the values in these matrices for a synthesized utterance of three states are:

$$B = \begin{pmatrix} \frac{1}{\sigma_{q1}^2} + \frac{1}{\gamma_{q2}^2} & -\frac{1}{\gamma_{q2}^2} & 0 \\ -\frac{1}{\gamma_{q2}^2} & \frac{1}{\sigma_{q2}^2} + \frac{1}{\gamma_{q2}^2} + \frac{1}{\gamma_{q3}^2} & -\frac{1}{\gamma_{q3}^2} \\ 0 & -\frac{1}{\gamma_{q3}^2} & \frac{1}{\sigma_{q3}^2} + \frac{1}{\gamma_{q3}^2} \end{pmatrix} \quad \text{EQ. 47}$$

$$c = \begin{pmatrix} \frac{\mu_{q1}}{\sigma_{q1}^2} - \frac{\delta_{q2}}{\gamma_{q2}^2} & \frac{\mu_{q2}}{\sigma_{q2}^2} + \frac{\delta_{q2}}{\gamma_{q2}^2} - \frac{\delta_{q3}}{\gamma_{q3}^2} & \frac{\mu_{q3}}{\sigma_{q3}^2} + \frac{\delta_{q3}}{\gamma_{q3}^2} \end{pmatrix} \quad \text{EQ. 48}$$

$$X = \begin{pmatrix} Fl_1 \\ Fl_2 \\ Fl_3 \end{pmatrix} \quad \text{EQ. 49}$$

Note that B is once again a tridiagonal matrix where all of the values are zero except those in the main diagonal and its two adjacent diagonals. This remains true regardless of the number of states in the output speech signal.

To solve for the sequence of values for a constituent (F1, F2, F3, B1, B2, or B3), the inverse of B is multiplied by c. This produces the sequence of values that has a maximum probability.

This process is then repeated for each constituent to produce a single most likely sequence of values for each formant constituent in the utterance being produced.

Once the most likely sequence of values for each formant constituent has been determined by formant path generator 628 of FIG. 9, the path generator adjusts three resonators 632, 634 and 636 so that they respectively resonate at the first, second and third formant frequencies for that state. Formant path generator 628 also adjust resonators 632, 634, and 636 so that they resonate with a bandwidth equal to the respective bandwidth of the first, second and third formants of the current state.

Once the resonators have been adjusted, the excitation signal is serially passed through each of the resonators. The output of third resonator 636 thereby provides the synthesized speech signal.

Although the present invention has been described with reference to particular embodiments, workers skilled in the art will recognize that changes may be made in form and detail without departing from the spirit and scope of the invention.

What is claimed is:

1. A method of synthesizing speech from text, the method comprising:

representing the text as a sequence of formant model states;

generating an excitation signal for each formant model state;

determining at least one formant path over the sequence of formant model states based on a formant model for each formant model state; and passing each excitation signal through a resonator having characteristics that are based on a formant along a formant path and aligned with the respective formant model state of each excitation signal.

2. The method of claim 1 wherein determining a formant path comprises solving linear equations that each equate a partial derivative of a probability function to zero, the probability function describing the probability of at least one formant path.

3. The method of claim 2 wherein solving the linear equations comprises solving one set of linear equations for a sequence of formant frequencies along a formant path and solving a second set of linear equations for a sequence of formant bandwidths along the same formant path.

4. The method of claim 2 wherein solving the linear equations comprises solving one set of linear equations for a sequence of formant frequencies along a first formant path and solving a second set of linear equation for a sequence of formant frequencies along a second formant path.

5. The method of claim 4 wherein solving the linear equations further comprises solving one set of linear equations for a sequence of formant bandwidths along the first formant path and solving a second set of linear equation for a sequence of formant bandwidths along the second formant path.

6. The method of claim 2 wherein solving the linear equations comprises solving equations having terms that describe the mean change in formant frequencies between two neighboring formant model states.

7. The method of claim 2 wherein solving the linear equations comprises solving equations having terms that describe the mean change in formant bandwidths between two neighboring formant model states.

8. The method of claim 1 wherein determining at least one formant path comprises determining a separate formant path for three different formants.

9. The method of claim 8 wherein passing each excitation signal through at least one resonator comprises:

passing each excitation signal through a first resonator having characteristics that are based on a formant along a first formant path, the effects of the first resonator on each excitation signal producing a first resonator output signal;

passing the first resonator output signal through a second resonator having characteristics that are based on a formant along a second formant path, the effects of the second resonator on the first resonator output signal producing a second resonator output signal; and passing the second resonator output signal through a third resonator having characteristics that are based on a formant along a third formant path, the effects of the third resonator on the second resonator output signal producing a representation of the synthesized speech signal.

10. A computer-readable medium having computer-executable components comprising:

a state generation component capable of generating a sequence of formant model states from a text;

an excitation generation component capable of generating a representation of a segment of an excitation signal for each formant model state;

a formant model storage unit comprising a formant model for each formant model state;

a formant path generator capable of identifying a sequence of formants based on the formant models associated with the sequence of formant model states;

a resonator unit, receiving the representation of the excitation signal as an input signal and capable of resonating with a center frequency and bandwidth that is determined by a formant in the sequence of formants.

11. The computer-readable medium of claim 10 wherein the formant storage unit comprises a mean and variance for the frequency of each formant in each formant model state.

12. The computer-readable medium of claim 11 wherein the formant storage unit further comprises a mean and variance for the bandwidth of each formant in each formant model state.

13. The computer-readable medium of claim 12 wherein the formant storage unit further comprises a mean and variance for the change in frequency between formant model states for each formant in each formant model state.

14. The computer-readable medium of claim 13 wherein the formant storage unit further comprises a mean and variance for the change in bandwidth between formant model states for each formant in each formant model state.

15. The computer-readable medium of claim 10 wherein the formant storage unit comprises a formant model for each formant of a set of formants for each formant model state.

16. The computer-readable medium of claim 15 wherein the formant path generator identifies a first and second sequence of formants and wherein the resonator unit comprises first and second resonator sub-units, where the first resonator sub-unit is capable of resonating with a center frequency and bandwidth that is determined by a formant in the first sequence of formants and the second resonator sub-unit is capable of resonating with a center frequency and bandwidth that is determined by a formant in the second sequence of formants.

17. The computer-readable medium of claim 16 wherein the formant path generator further identifies a third sequence of formants and wherein the resonator unit further comprises a third resonator sub-unit, the third resonator sub-unit being capable of resonating with a center frequency and bandwidth that is determined by a formant in the third sequence of formants.

18. The computer-readable medium of claim 10 wherein the formant path generator comprises an equation solver capable of solving sets of equations that equate partial derivatives of a probability function to zero.

19. The computer-readable medium of claim 18 wherein the equation solver solves one set of equations for formant frequencies in the sequence of formants and a second set of equations for formant bandwidths in the sequence of formants.

20. The computer-readable medium of claim 18 wherein the equation solver solves one set of equations for formant frequencies in a first sequence of formants and a second set of equations for formant frequencies in a second sequence of formants.

* * * * *

UNITED STATES PATENT AND TRADEMARK OFFICE

CERTIFICATE OF CORRECTION

PATENT NO. : 6,708,154 B2
DATED : March 16, 2004
INVENTOR(S) : Acero

It is certified that error appears in the above-identified patent and that said Letters Patent is hereby corrected as shown below:

Column 12,
Line 51, "FORMAT" should be -- FORMANT --

Column 9,
Equation 21, "$\frac{1}{2}\sum_{t=1}^{T}(g_t - x_t)'\Psi_t^{-1}(g_t - x_t) =$" should read -- $-\frac{1}{2}\sum_{t=1}^{T}(g_t - x_t)'\Psi_t^{-1}(g_t - x_t) =$ --

Signed and Sealed this

Tenth Day of August, 2004

JON W. DUDAS
*Acting Director of the United States Patent and Trademark Office*